US007219060B2

(12) United States Patent
Coorman et al.

(10) Patent No.: US 7,219,060 B2
(45) Date of Patent: May 15, 2007

(54) SPEECH SYNTHESIS USING CONCATENATION OF SPEECH WAVEFORMS

(75) Inventors: Geert Coorman, Kortrijk (BE); Filip Deprez, Kortrijk (BE); Mario De Bock, Ronse (BE); Justin Fackrell, Ghent (BE); Steven Leys, Kortrijk (BE); Peter Rutten, Ghent (BE); Jan De Moortel, Kortrijk (BE); Andre Schenk, Kortrijk (BE); Bert Van Coile, Bruges (BE)

(73) Assignee: Nuance Communications, Inc., Burlington, MA (US)

( * ) Notice: Subject to any disclaimer, the term of this patent is extended or adjusted under 35 U.S.C. 154(b) by 383 days.

(21) Appl. No.: 10/724,659

(22) Filed: Dec. 1, 2003

(65) Prior Publication Data

US 2004/0111266 A1 Jun. 10, 2004

Related U.S. Application Data

(63) Continuation of application No. 09/438,603, filed on Nov. 12, 1999, now Pat. No. 6,665,641.

(60) Provisional application No. 60/108,201, filed on Nov. 13, 1998.

(51) Int. Cl.
*G10L 13/02* (2006.01)

(52) U.S. Cl. ..... 704/258; 704/260

(58) Field of Classification Search ..... 704/258, 704/260

See application file for complete search history.

(56) References Cited

U.S. PATENT DOCUMENTS 5,153,913 A * 10/1992 Kandefer et al. ..... 704/260
5,384,893 A 1/1995 Hutchins ..... 704/246
5,479,564 A 12/1995 Vogten et al. ..... 395/2.76
5,490,234 A 2/1996 Narayan ..... 395/2.69
5,611,002 A 3/1997 Vogten et al. ..... 395/2.76
5,630,013 A 5/1997 Suzuki et al. ..... 395/2.25
5,749,064 A 5/1998 Pawate et al. ..... 704/213
5,774,854 A 6/1998 Sharman ..... 704/260
5,913,193 A 6/1999 Huang et al. ..... 704/258
5,920,840 A 7/1999 Satyamurti et al. ..... 704/267
5,978,764 A 11/1999 Lowry et al. ..... 704/258

OTHER PUBLICATIONS

Black, Alan W, et al, "CHATR: a genetic speech synthesis system", In Proceedings of Coling, 94 Kyoto, Japan.
Campbell, Nick, "Processing a Speech Corpus for Synthesis with Chatr", ICSP '97 (International Conference on Speech Processing), Seoul, Korea Aug. 26, 1997.
Banga, Eduardo R., et al, "Shape-Invariant Pitch-Synchronous Text-to-Speech Conversion", Proceedings of the International Conference on Acoustic, Speech, and Signal Processing (ICASSP), IEEE, 1995, pp. 656-659.
Black, Alan W., et al. "Automatically Clustering Similar Units for Unit Selection in Speech Synthesis", Proceedings of Eurospeech 97, Sep. 1997, pp. 601-604, Rhodes, Greece.
Black, Alan W., et al "Optimising Selection of Units from Speech Databases for Concatenative Synthesis", European Conference on Speech Communication and Technology, Madrid, Sep. 1995, pp. 581-584.
Campbell, Nick, et al "Chatr: A Natural Speech Re-Sequencing Synthesis System".
Charpentier, F. J., et al "Diphone Synthesis Using an Overlap-Add Technique for Speech Wavefoms Concatenation", IEEE, 1986, pp. 2015-2018.

(Continued)

*Primary Examiner*—Daniel Abebe
(74) *Attorney, Agent, or Firm*—Bromberg & Sunstein LLP

(57) ABSTRACT

A high quality speech synthesizer in various embodiments concatenates speech waveforms referenced by a large speech database. Speech quality is further improved by speech unit selection and concatenation smoothing.

6 Claims, 2 Drawing Sheets

OTHER PUBLICATIONS

Conkie, Alistair D. "Optimal Coupling of Diphones", in J.P.H. van Santen, et al , editors, Progress in Speech Synthesis, Springer verlag, 1997, pp. 293-304.
Ding, Wen, et al "Optimising Unit Selection with Voice Source and Formats in the Chatr Speech Synthesis System", Proceedings of Eurospeech 97, Sep. 1997, pp. 537-540, Rhodes, Greece.
Dutoit, T., "High Quality Test-to-Speech Synthesis: A Comparison of Four Candidate Algorithms", IEEE, 1994, pp. I-565-I-568.
Edgington, M., "Investigating the Limitations of Concatenative Synthesis", Eurospeech, 1997, pp. 1-4.
Edgington, M., et al, "Overview of Current Text-to-Speech Techniques: Part II—Prosody and Speech Generation", BT Technology Journal, vol. 14, No. 1, Jan. 1996, pp. 84-99.
Hamdy, Khaled N., et al "Time-Scale Modification of Audio Signals with Combined Harmonic and Wavelet Representations", Proceedings of ICASSP 97, pp. 439-442, Munich, Germany.
Hauptmann, Alexander G. "Speakez: A First Experiment in Concatenation Synthesis from a Large Corpus", Proceedings of Eurospeech93, Sep. 1993, pp. 1701-1705, Berlin, Germany.
Hess, Wolfgang J. "Speech Synthesis—A Solved Problem?", Signal Processing, Elsevier Science Publishers B.V., 1992.
Hirokawa, Tomohisa, et al, "High Quality Speech Synthesis System Based on Waveform Concatenation of Phoneme Segment", IEICE Trans. Fundamentals, vol. E76-A, No. 11, Nov. 1993, pp. 1964-1970.
Huang, X., et al "Recent Improvements on Microsoft's Trainable Text-to-Speech System—Whistler", Proceedings of ICASSP '97, Apr. 1997, pp. 959-962, Munich, Germany.
Hunt, Andrew J., et al "Unit Selection in a Concatenative Speech Synthesis System Using a Large Speech Database" , IEEE International Conference on Acoustics, Speech and Signal Processing Conference Proceedings, May 1996, vol. 1, pp. 373-376.
Iwahashi, Naoto, et al "Concatenative Speech Synthesis by Minimum Distortion Criteria", IEEE, 1992, pp. II-65-II-68.
Iwahashi, Naoto, et al "Speech Segment Network Approach for Optimization of Synthesis Unit Set", Computer Speech and Language, 1995, pp. 335-352.
King, Simon, et al "Speech Synthesis Using Non-Uniform Units in the Verbmobil Project", Proceedings of Eurospeech '97, Europress, 97, Sep. 1997, pp. 569-572, Rhodes, Greece.
Klatt, Dennis H., "Review of Text-to-Speech Conversion for English", Journal of Acoustic Society of America, 82 (3) Sep. 1987, pp. 737-793.
Lee, Sungjoo, et al "Variable Time-Scale Modification of Speech Using Transient Information", Proceedings of ICASSP '97, Apr. 1997, pp. 1319-1322, Munich, Germany.
Lin, Gang-Janp, et al "High Quality of Low Complexity Pitch Modification of Acoustic Signals", IEEE, 1995, pp. 2987-2990.
Kraft, Volker, "Does the Resulting Speech Quality Improvement Make a Sophisticated Concatenation of Time-Domain Synthesis Units Worthwhile?", Proc. 2.sup.nd ESCA/IEEE Workshop on Speech Synthesis, 1994, pp. 65-68.
Laroche, Jean, et al, "HNS: Speech Modification Based on a Harmonic+Noise Model",IEEE, 1993, pp. II-550-II-553.
Moulines, E., et al, "A Real-Time French Text-to-Speech System Generating High-Quality Synthetic Speech", International Conference on Acoustics, Speech & Signal Processing, ICASSP, IEEE, 1990, vol. 15, pp. 309-312.
Nakajima, Shin'ya, "Automatic Synthesis Unit Generation for English Speech Synthesis Based on Multi-Layered Context Oriented Clustering", Speech Communication, vol. 14, 1994, pp. 313-324.
Portele, Thomas, et al, "A Mixed Inventory Structure for German Concatenative Synthesis", Progress in Speech Synthesis, J.P.H. van Santen, et al, editors, Springer verlag, 1997, pp. 263-277.
Quartieri, T.F., et al "Time-Scale Modification of Complex Acoustic Signals", IEEE, 1993, pp. I-213-216.
Rudnicky, Alexander, I., et al, "Survey of Current Speech Technology", Communication of the ACM, vol. 37, No. 3, Mar. 1994, pp. 52-57.
Sagisaka, Yoshinori, "Speech Synthesis by Rule Using an Optimal Selection of Non-Uniform Synthesis Units", IEEE, 1998, pp. 679-682.
Saito, Takashi, et al, "High-Quality Speech Synthesis Using Context-Dependent Syllabic Units", Proceedings of ICASSP '96, May 1996, pp. 381-384, Atlanta, Georgia.
Verhelst, Werner, et al, "An Overlap-Add Technique Based on Waveform Similiarity (WSOLA) for High Qualtiy Time-Scale Modification of Speech", IEEE, 1993, pp. II-554-II-557.
Yim, S., et al, "Computationally Efficient Algorithm for Time Scale Modification GLS-TSM", Proceedings of ICASSP '96, May 1996, pp. 1009-1012, Atlanta, Georgia.

* cited by examiner

ORGANISATION OF THE SPEECH UNIT DATABASE

SPEECH SYNTHESIS USING CONCATENATION OF SPEECH WAVEFORMS

CROSS REFERENCE TO RELATED APPLICATIONS

This application is a continuation of application Ser. No. 09/438,603, filed Nov. 12, 1999, now U.S. Pat. No. 6,665, 641 which in turn claims priority from U.S. provisional patent application 60/108,201, filed Nov. 13, 1998, the contents of which are incorporated herein by reference.

TECHNICAL FIELD

The present invention relates to a speech synthesizer based on concatenation of digitally sampled speech units from a large database of such samples and associated phonetic, symbolic, and numeric descriptors.

BACKGROUND ART

A concatenation-based speech synthesizer uses pieces of natural speech as building blocks to reconstitute an arbitrary utterance. A database of speech units may hold speech samples taken from an inventory of pre-recorded natural speech data. Using recordings of real speech preserves some of the inherent characteristics of a real person's voice. Given a correct pronunciation, speech units can then be concatenated to form arbitrary words and sentences. An advantage of speech unit concatenation is that it is easy to produce realistic coarticulation effects, if suitable speech units are chosen. It is also appealing in terms of its simplicity, in that all knowledge concerning the synthetic message is inherent to the speech units to be concatenated. Thus, little attention needs to be paid to the modeling of articulatory movements. However speech unit concatenation has previously been limited in usefulness to the relatively restricted task of neutral spoken text with little, if any, variations in inflection.

A tailored corpus is a well-known approach to the design of a speech unit database in which a speech unit inventory is carefully designed before making the database recordings. The raw speech database then consists of carriers for the needed speech units. This approach is well-suited for a relatively small footprint speech synthesis system. The main goal is phonetic coverage of a target language, including a reasonable amount of coarticulation effects. No prosodic variation is provided by the database, and the system instead uses prosody manipulation techniques to fit the database speech units into a desired utterance.

For the construction of a tailored corpus, various different speech units have been used (see, for example, Matt, D. H., "Review of text-to-speech conversion for English," J. Acoust. Soc. Am. 82(3), September 1987). Initially, researchers preferred to use phonemes because only a small number of units was required—approximately forty for American English—keeping storage requirements to a minimum. However, this approach requires a great deal of attention to coarticulation effects at the boundaries between phonemes. Consequently, synthesis using phonemes requires the formulation of complex coarticulation rules.

Coarticulation problems can be minimized by choosing an alternative unit. One popular unit is the diphone, which consists of the transition from the center of one phoneme to the center of the following one. This model helps to capture transitional information between phonemes. A complete set of diphones would number approximately 1600, since there are approximately $(40)^2$ possible combinations of phoneme pairs. Diphone speech synthesis thus requires only a moderate amount of storage. One disadvantage of diphones is that they lead to a large number of concatenation points (one per phoneme), so that heavy reliance is placed upon an efficient smoothing algorithm, preferably in combination with a diphone boundary optimization. Traditional diphone synthesizers, such as the TTS3000 of Lernout & Hauspie Speech and Language Products N.V., use only one candidate speech unit per diphone. Due to the limited prosodic variability, pitch and duration manipulation techniques are needed to synthesize speech messages. In addition, diphones synthesis does not always result in good output speech quality.

Syllables have the advantage that most coarticulation occurs within syllable boundaries. Thus, concatenation of syllables generally results in good quality speech. One disadvantage is the high number of syllables in a given language, requiring significant storage space. In order to minimize storage requirements while accounting for syllables, demi-syllables were introduced. These half-syllables, are obtained by splitting syllables at their vocalic nucleus. However the syllable or demi-syllable method does not guarantee easy concatenation at unit boundaries because concatenation in a voiced speech unit is always more difficult that concatenation in unvoiced speech units such as fricatives.

The demi-syllable paradigm claims that coarticulation is minimized at syllable boundaries and only simple concatenation rules are necessary. However this is not always true. The problem of coarticulation can be greatly reduced by using word-sized units, recorded in isolation with a neutral intonation. The words are then concatenated to form sentences. With this technique, it is important that the pitch and stress patterns of each word can be altered in order to give a natural sounding sentence. Word concatenation has been successfully employed in a linear predictive coding system.

Some researchers have used a mixed inventory of speech units in order to increase speech quality, e.g., using syllables, demi-syllables, diphones and suffixes (see, Hess, W. J., "Speech Synthesis—A Solved Problem, Signal processing VI: Theories and Applications," J. Vandewalle, R. Boite, M. Moonen, A. Oosterlinck (eds.), Elsevier Science Publishers B.V., 1992).

To speed up the development of speech unit databases for concatenation synthesis, automatic synthesis unit generation systems have been developed (see, Nakajima, S., "Automatic synthesis unit generation for English speech synthesis based on multi-layered context oriented clustering," Speech Communication 14 pp. 313–324, Elsevier Science Publishers B.V., 1994). Here the speech unit inventory is automatically derived from an analysis of an annotated database of speech—i.e. the system 'learns' a unit set by analyzing the database. One aspect of the implementation of such systems involves the definition of phonetic and prosodic matching functions.

A new approach to concatenation based speech synthesis was triggered by the increase in memory and processing power of computing devices. Instead of limiting the speech unit databases to a carefully chosen set of units, it became possible to use large databases of continuous speech, use non-uniform speech units, and perform the unit selection at run-time. This type of synthesis is now generally known as corpus-based concatenative speech synthesis.

The first speech synthesizer of this kind was presented in Sagisaka, Y., "Speech synthesis by rule using an optimal selection of non-uniform synthesis units," ICASSP-88 New York vol. 1 pp. 679–682, IEEE, April 1988. It uses a speech database and a dictionary of candidate unit templates, i.e. an inventory of all phoneme sub-strings that exist in the database. This concatenation based synthesizer operates as follows.

(1) For an arbitrary input phoneme string, all phoneme sub-strings in a breath group are listed,
(2) All candidate phoneme sub-strings found in the synthesis unit entry dictionary are collected,
(3) Candidate phoneme sub-strings that show a high contextual similarity with the corresponding portion in the input string are retained,
(4) The most preferable synthesis unit sequence is selected mainly by evaluating the continuities (based only on the phoneme string) between unit templates,
(5) The selected synthesis units are extracted from linear predictive coding (LPC) speech samples in the database,
(6) After being lengthened or shortened according to the segmental duration calculated by the prosody control module, they are concatenated together.

Step (3) is based on an appropriateness measure—taking into account four factors: conservation of consonant-vowel transitions, conservation of vocalic sound succession, long unit preference, overlap between selected units. The system was developed for Japanese, the speech database consisted of 5240 commonly used words.

A synthesizer that builds further on this principle is described in Hauptmann, A. G., "SpeakEZ: A first experiment in concatenation synthesis from a large corpus," Proc. Eurospeech '93, Berlin, pp. 1701–1704, 1993. The premise of this system is that if enough speech is recorded and catalogued in a database, then the synthesis consists merely of selecting the appropriate elements of the recorded speech and pasting them together. It uses a database of 115,000 phonemes in a phonetically balanced corpus of over 3200 sentences. The annotation of the database is more refined than was the case in the Sagisaka system: apart from phoneme identity there is an annotation of phoneme class, source utterance, stress markers, phoneme boundary, identity of left and right context phonemes, position of the phoneme within the syllable, position of the phoneme within the word, position of the phoneme within the utterance, pitch peak locations.

Speech unit selection in the SpeakEZ is performed by searching the database for phonemes that appear in the same context as the target phoneme string. A penalty for the context match is computed as the difference between the immediately adjacent phonemes surrounding the target phoneme with the corresponding phonemes adjacent to the database phoneme candidate. The context match is also influenced by the distance of the phoneme to its left and right syllable boundary, left and right word boundary, and to the left and right utterance boundary.

Speech unit waveforms in the SpeakEZ are concatenated in the time domain, using pitch synchronous overlap-add (PSOLA) smoothing between adjacent phonemes. Rather than modify existing prosody according to ideal target values, the system uses the exact duration, intonation and articulation of the database phoneme without modifications. The lack of proper prosodic target information is considered to be the most glaring shortcoming of this system.

Another approach to corpus-based concatenation speech synthesis is described in Black, A. W., Campbell, N., "Optimizing selection of units from speech databases for concatenative synthesis," Proc. Eurospeech '95, Madrid, pp. 581–584, 1995, and in Hunt, A. J., Black, A. W., "Unit selection in a concatenative speech synthesis system using a large speech database," ICASSP-96, pp. 373–376,1996. The annotation of the speech database is taken a step further to incorporate acoustic features: pitch ($F_0$), power and spectral parameters are included. The speech database is segmented in phone-sized units. The unit selection algorithm, operates as follows:

(1) A unit distortion measure $D_u(u_i, t_i)$ is defined as the distance between a selected unit $u_i$ and a target speech unit $t_i$, i.e. the difference between the selected unit feature vector $\{uf_1, uf_2, \ldots, uf_n\}$ and the target speech unit vector $\{tf_1, tf_2, \ldots, tf_n\}$ weights vector $W_u\{w_1, w_2, \ldots, w_n\}$.
(2) A continuity distortion measure $D_c(u_i\ u_{i-1})$ is defined as the distance between a selected unit and its immediately adjoining previous selected unit, defined as the difference between a selected units unit's feature vector and its previous one multiplied by a weight vector $W_c$.
(3) The best unit sequence is defined as the path of units from the database which minimizes:

$$\sum_{i=1}^{n} (D_c(u_i, u_{i-1}) * W_c + D_u(u_i, t_i) * W_u)$$

where n is the number of speech units in the target utterance.

In continuity distortion, three features are used: phonetic context, prosodic context, and acoustic join cost. Phonetic and prosodic context distances are calculated between selected units and the context (database) units of other selected units. The acoustic join cost is calculated between two successive selected units. The acoustic join cost is based on a quantization of the mel-cepstrum, calculated at the best joining point around the labeled boundary.

A Viterbi search is used to find the path with the minimum cost as expressed in (3). An exhaustive search is avoided by pruning the candidate lists at several stages in the selection process. Units are concatenated without doing any signal processing (i.e., raw concatenation).

A clustering technique is presented in Black, A. W., Taylor, P., "Automatically clustering similar units for unit selection in speech synthesis," Proc. Eurospeech '97, Rhodes, pp. 601–604, 1997, that creates a CART (classification and regression tree) for the units in the database. The CART is used to limit the search domain of candidate units, and the unit distortion cost is the distance between the candidate unit and its cluster center.

As an alternative to the mel-cepstrum, Ding, W., Campbell, N., "Optimising unit selection with voice source and formants in the CHATR speech synthesis system," Proc. Eurospeech '97, Rhodes, pp. 537–540, 1997, presents the use of voice source parameters and formant information as acoustic features for unit selection.

Each of the references mentioned above is hereby incorporated herein by reference.

SUMMARY OF THE INVENTION

Embodiments of the present invention are directed to a system for speech unit selection. A large speech database references speech waveforms and associated symbolic prosodic features. The speech database is accessed by speech waveform designators, and at least one designator is associated with a sequence of one or more diphones. A speech waveform selector is in communication with the speech database, and selects based, at least in part, on the symbolic prosodic features stored in the speech database, waveforms referenced by the speech database. The speech waveform selector may use criteria that favor approximately equally all waveform candidates having low level prosody features within a target range determined as a function of high level linguistic features.

Another embodiment includes a large speech database referencing speech waveforms, and a speech waveform selector, in communication with the speech database. The selector selects waveforms referenced by the speech database using criteria that, at least in part, favor (i) waveform candidates based directly on high level prosody features, and (ii) approximately equally all waveform candidates having low level prosody features within a target range determined as a function of high level linguistic features.

According to any of these embodiments, the criteria may include a first requirement favoring waveform candidates having pitch within a target range determined as a function of high level linguistic features. Alternatively or in addition, the criteria may include a second requirement favoring waveform candidates having a duration within a target range determined as a function of high level linguistic features. Or the criteria may include a third requirement favoring waveform candidates having coarse pitch continuity within a target range determined as a function of high-level linguistic features.

In various embodiments, the synthesizer may operate to select among waveform candidates without recourse to specific target duration values or specific target pitch contour values over time.

BRIEF DESCRIPTION OF THE DRAWINGS

The present invention will be more readily understood by reference to the following detailed description taken with the accompanying drawings, in which.

DETAILED DESCRIPTION OF SPECIFIC EMBODIMENTS

Overview

Figure 1:
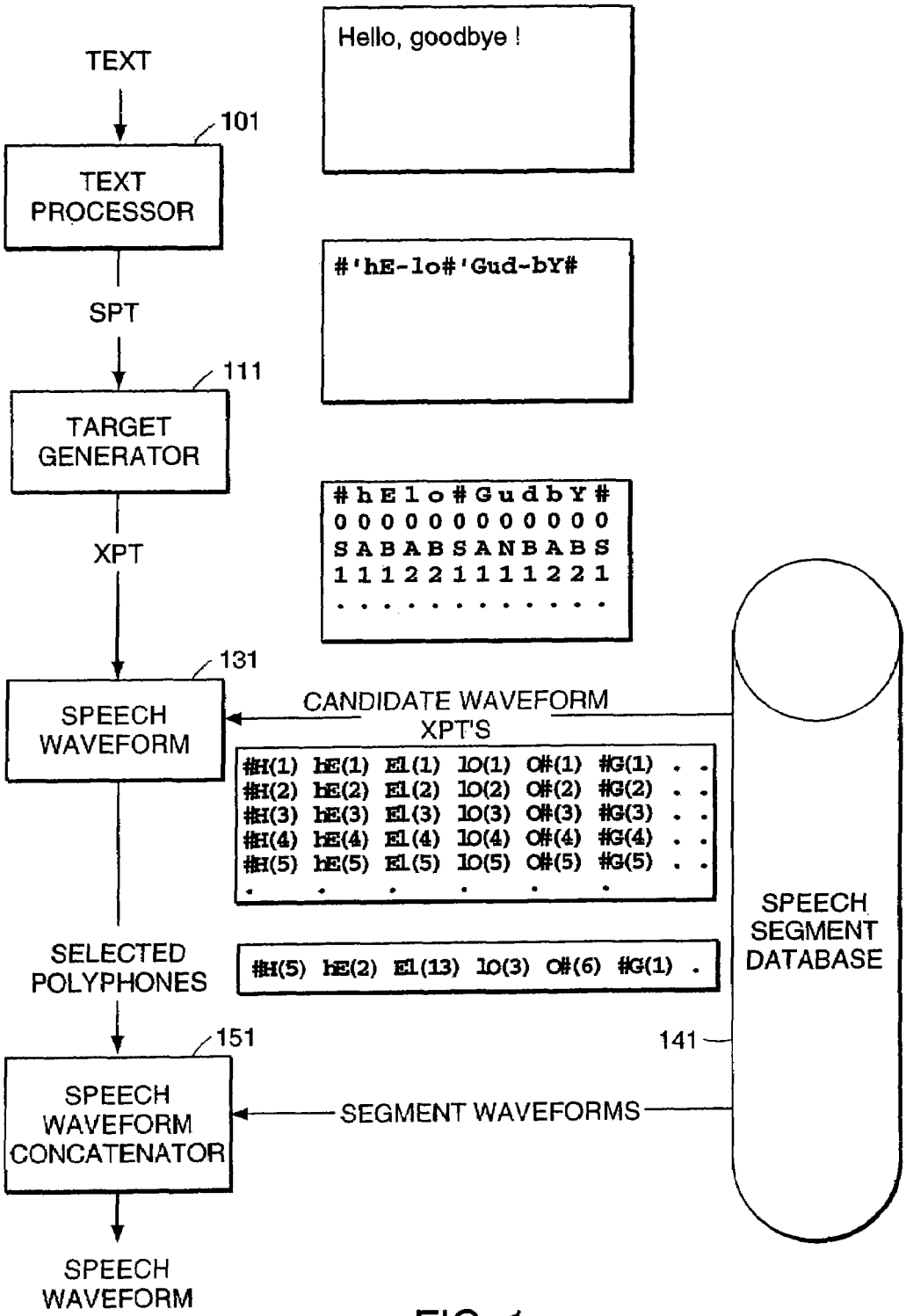
FIG. 1 illustrates speech synthesis according to a representative embodiment.

A representative embodiment of the present invention, known as the RealSpeak™ Text-to-Speech (TTS) engine, produces high quality speech from a phonetic specification, that can be the output of a text processor, known as a target, by concatenating parts of real recorded speech held in a large database. The main process objects that make up the engine, as shown in FIG. 1, include a text processor 101, a target generator 111, a speech unit database 141, a waveform selector 131, and a speech waveform concatenator 151.

The speech unit database 141 contains recordings, for example in a digital format such as PCM, of a large corpus of actual speech that are indexed in individual speech units by their phonetic descriptors, together with associated speech unit descriptors of various speech unit features. In one embodiment, speech units in the speech unit database 141 are in the form of a diphone, which starts and ends in two neighboring phonemes. Other embodiments may use differently sized and structured speech units. Speech unit descriptors include, for example, symbolic descriptors, e.g., lexical stress, word position, etc.—and prosodic descriptors, e.g. duration, amplitude, pitch, etc.

The text processor 101 receives a text input, e.g., the text phrase "Hello, goodbye!" The text phrase is then converted by the text processor 101 into an input phonetic data sequence. In FIG. 1, this is a simple phonetic transcription: #'hE-1O#' Gud-bY#. In various alternative embodiments, the input phonetic data sequence may be in one of various different forms. The input phonetic data sequence is converted by the target generator 111 into a multi-layer internal data sequence to be synthesized. This internal data sequence representation, known as extended phonetic transcription (XPT), includes phonetic descriptors, symbolic descriptors, and prosodic descriptors such as those in the speech unit database 141.

The waveform selector 131 retrieves from the speech unit database 141 descriptors of candidate speech units that can be concatenated into the target utterance specified by the XPT transcription. The waveform selector 131 creates an ordered list of candidate speech units by comparing the XPTs of the candidate speech units with the XPT of the target XPT, assigning a node cost to each candidate. Candidate-to-target matching is based on symbolic descriptors, such as phonetic context and prosodic context, and numeric descriptors and determines how well each candidate fits the target specification. Poorly matching candidates maybe excluded at this point.

The waveform selector 131 determines which candidate speech units can be concatenated without causing disturbing quality degradations such as clicks, pitch discontinuities, etc. Successive candidate speech units are evaluated by the waveform selector 131 according to a quality degradation cost function.

Candidate-to-candidate matching uses frame based information such as energy, pitch and spectral information to determine how well the candidates can be joined together. Using dynamic programming, the best sequence of candidate speech units is selected for output to the speech waveform concatenator 151.

The speech waveform concatenator 151 requests the output speech units (diphones and/or polyphones) from the speech unit database 141 for the speech waveform concatenator 151. The speech waveform concatenator 151 concatenates the speech units selected forming the output speech that represents the target input text.

Operation of various aspects of the system will now be described in greater detail.

Speech Unit Database

Figure 2:
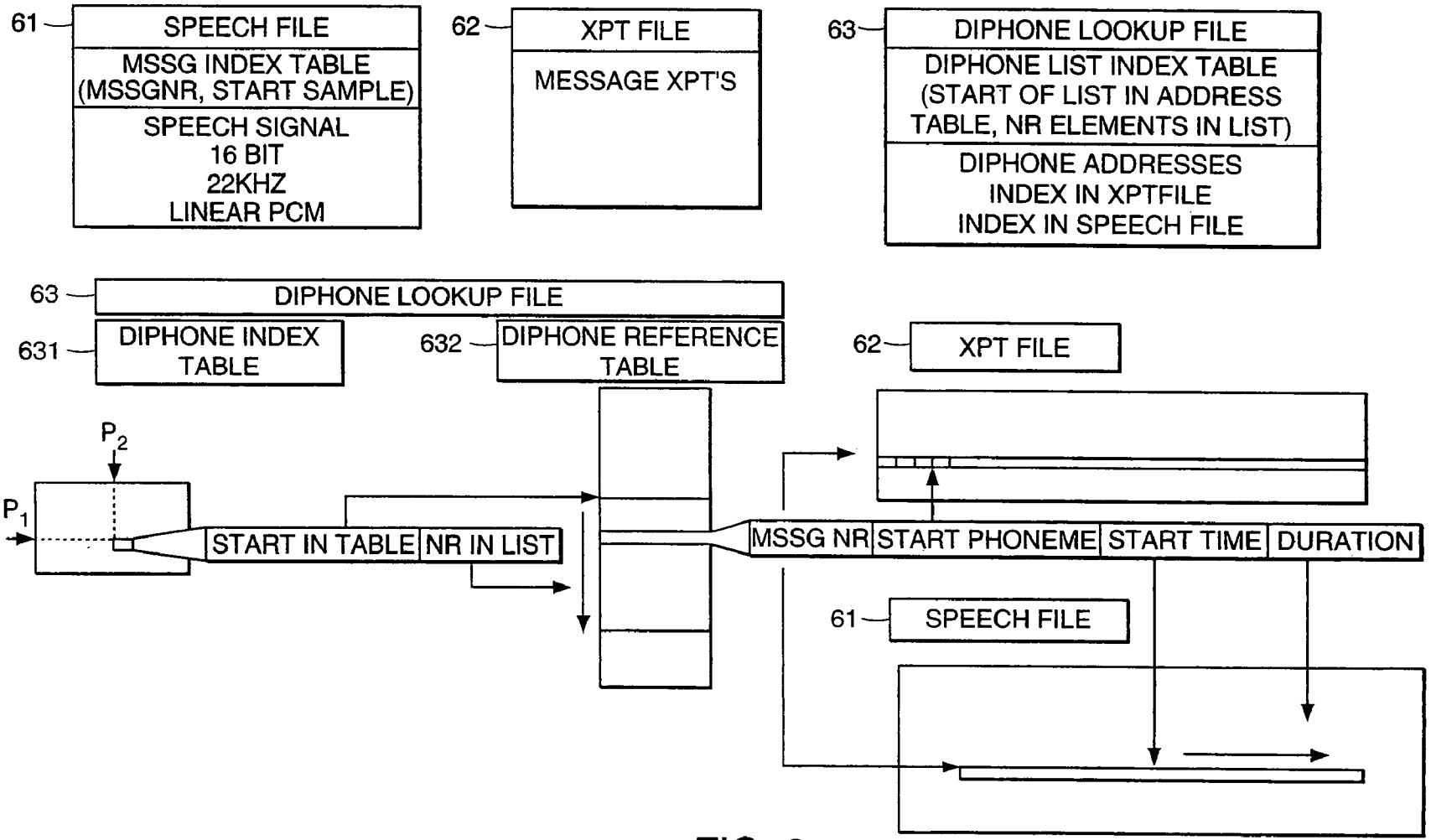
FIG. 2 illustrates the structure of the speech unit database in a representative embodiment.

As shown in FIG. 2, the speech unit database 141 contains three types of files:

(1) a speech signal file 61

(2) a time-aligned extended phonetic transcription (XPT) file 62, and (3) a diphone lookup table 63.

Database Indexing

Each diphone is identified by two phoneme symbols—these two symbols are the key to the diphone lookup table 63. A diphone index table 631 contains an entry for each possible diphone in the language, describing where the references of these diphones can be found in the diphone reference table 632. The diphone reference table 632 contains references to all the diphones in the speech unit database 141. These references are alphabetically ordered by diphone identifier. In order to reference all diphones by identity it is sufficient to specify where a list starts in the diphone lookup table 63, and how many diphones it contains. Each diphone reference contains the number of the message (utterance) where it is found in the speech unit database 141, which phoneme the diphone starts at, where the diphone starts in the speech signal, and the duration of the diphone.

XPT

A significant factor for the quality of the system is the transcription that is used to represent the speech signals in the speech unit database 141. Representative embodiments set out to use a transcription that will allow the system to use the intrinsic prosody in the speech unit database 141 without requiring precise pitch and duration targets. This means that the system can select speech units that are matched phonetically and prosodically to an input transcription. The concatenation of the selected speech units by the speech waveform concatenator 151 effectively leads to an utterance with the desired prosody.

The XPT contains two types of data: symbolic features (i.e., features that can be derived from text) and acoustic features (i.e., features that can only be derived from the recorded speech waveform): Table 1a in the Tables Appendix illustrates the XPT of an example message: "You couldn't be sure he was still asleep." Table 1b in the Tables Appendix describes each of the various symbolic and acoustic features in XPT.

To effectively extract speech units from the speech unit database 141, the XPT typically contains a time aligned phonetic description of the utterance. The start of each phoneme in the signal is included in the transcription; The XPT also contains a number of prosody related cues, e.g., accentuation and position information. Apart from symbolic information, the transcription also contains acoustic information related to prosody, e.g. the phoneme duration. A typical embodiment concatenates speech units from the speech unit database 141 without modification of their prosodic or spectral realization. Therefore, the boundaries of the speech units should have matching spectral and prosodic realizations. This information is typically incorporated into the XPT by a boundary pitch value and a vector index that refers to a phoneme dependent codebook of spectral vectors. The boundary pitch value and the vector index are calculated at the polyphone edges.

Database Storage

Different types of data in the speech unit database 141 may be stored on different physical media, e.g., hard disk, CD-ROM, DVD, random-access memory (RAM), etc. Data access speed may be increased by efficiently choosing how to distribute the data between these various media. The slowest accessing component of a computer system is typically the hard disk. If part of the speech unit information needed to select candidates for concatenation were stored on such a relatively slow mass storage device, valuable processing time would be wasted by accessing this slow device. A much faster implementation could be obtained if selection-related data were stored in RAM.

Thus in a representative embodiment, the speech unit database 141 is partitioned into frequently needed selection-related data 21—stored in RAM, and less frequently needed concatenation-related data 22—stored, for example, on CDROM or DVD. As a result, RAM requirements of the system remain modest, even if the amount of speech data in the database becomes extremely large (~Gbytes). The relatively small number of CD-ROM retrievals may accommodate multi-channel applications using one CD-ROM for multiple threads, and the speech database may reside alongside other application data on the CD (e.g., navigation systems for an auto-PC).

Optionally, speech waveforms may be coded and/or compressed using techniques well-known in the art.

Waveform Selection

Initially, each candidate list in the waveform selector 131 contains many available matching diphones in the speech unit database 141. Matching here means merely that the diphone identities match. Thus in an example of a diphone '#1' in which the initial '1' has primary stress in the target, the candidate list in the waveform selector 131 contains every '#1' found in the speech unit database 141, including the ones with unstressed or secondary stressed '1'. The waveform selector 131 uses Dynamic Programming (DP) to find the best sequence of diphones so that:

(1) the database diphones in the best sequence are similar to the target diphones in terms of stress, position, context, etc., and (2) the database diphones in the best sequence can be joined together with low concatenation artifacts.

In order to achieve these goals, two types of costs are used—a NodeCost which scores the suitability of each candidate diphone to be used to synthesize a particular target, and a TransitionCost which scores the 'joinability' of the diphones. These costs are combined by the DP algorithm, which finds the optimal path.

Cost Functions

The cost functions used in the unit selection may be of two types depending on whether the features involved are symbolic (i.e., non numeric, e.g., stress, prominence, phoneme context) or numeric (e.g., spectrum, pitch, duration). In a typical embodiment, a set of nonlinear cost functions has been defined for use in the unit selection. There are a variety of cost function shapes, with specific properties which help in the unit selection process. Each cost function takes as an input some pair of input x1 and x2 which are combined in someway to yield an output value y. The cost function shapes represent the different ways in which x1 and x2 may be compared.

Some cost function shapes involve x1 and x2 being symbolic (e.g., phone identity, prominence). The 'shape' of the cost function can then be expressed as a table, with x1 in the rows, x2 in the columns, and the 'cost' in the cells.

Other cost function shapes involve x1 and x2 being interval (e.g., pitch, duration). Then, x1 and x2 are compared in some way (e.g., $z=|x1-x2|$), and the cost function shape is used to map the result of this comparison to a cost value ($y=f(z)$). These cost functions can be plotted in the yz-plane, using the symbol y for the cost. Note that this is scaled after calculation to take into account user-defined weight values—in this discussion, each feature calculation produces an unscaled cost.

Cost Functions for Symbolic Features

For scoring candidates based on the similarity of their symbolic features (i.e., non numeric features) to specified target units, there are 'grey' areas between what is a good match and what is a bad match. The simplest cost weight function would be a binary 0/1. If the candidate has the same value as the target, then the cost is 0; if the candidate is something different, then the cost is 1. For example, when scoring a candidate for its stress (sentence accent (strongest), primary, secondary, unstressed (weakest)) for a target with the strongest stress, this simple system would score primary, secondary or unstressed candidates with a cost of 1. This is counter-intuitive, since if the target is the strongest stress, a candidate of primary stress is preferable to a candidate with no stress.

To accommodate this, the user can set up tables which describe the cost between any 2 values of a particular symbolic feature. Some examples are shown in Table 2 and Table 3 in the Tables Appendix which are called 'fuzzy tables' because they resemble concepts from fuzzy logic. Similar tables can be set up for any or all of the symbolic features used in the NodeCost calculation.

Fuzzy tables in the waveform selector 131 may also use special symbols, as defined by the developer linguist, which mean 'BAD' and 'VERY BAD'. In practice, the linguist puts a special symbol /1 for BAD, or /2 for VERY BAD in the fuzzy table, as shown in Table 4 in the Tables Appendix, for a target prominence of 3 and a candidate prominence of 0. It was previously mentioned that the normal minimum contribution from any feature is 0 and the maximum is 1. By using /1 or /2 the cost of feature mismatch can be made much higher than 1, such that the candidate is guaranteed to get a high cost. Thus, if for a particular feature the appropriate entry in the table is /1, then the candidate will rarely be used, and if the appropriate entry in the table is /2, then the candidate will almost never be used. In the example of Table 4, if the target prominence is 3, using a /1 makes it unlikely that a candidate with prominence 0 will ever be selected.

Cost Functions for Numeric Features

The waveform selector 131 may use special techniques for handling the cost functions of numeric features. Imprecise linguistic or acoustic knowledge, for example, how big a discontinuity in pitch can be perceived, may be encapsulated by flat-bottomed cost functions. The following form may be used for a flat-bottomed cost function for feature values x and y:

| | |
|---|---|
| Symmetric form: | $w(x, y) = 0$ if $\lvert x - y \rvert < T$,<br>$w(x, y) > 0$ otherwise. |
| Asymmetric form: | $w(x, y) = 0$ if $(x - y) >= 0$ and $(x - y) < T$,<br>$w(x, y) > 0$ otherwise. |
| Offset form: | $w(x) = 0$ if $T1 < x < T2$,<br>$w(x) > 0$ otherwise. |

For example, the mismatch of pitch between phones with the same accentuation (either both accented, or both unaccented) in the Transition Cost has a symmetric cost function. If the pitch at the right-hand edge of the left speech unit candidate is 'x' and the pitch at the left-hand edge of the right speech unit candidate is 'y', then when evaluating the pitch mismatch at the joining point of the left and right speech units, the cost is 0 if $\lvert x-y \rvert<T$. Thus a whole range of possible pitch values can result in a zero contribution to the cost.

The pitch anchors (explained elsewhere within) in the NodeCost use the offset form of the flat bottomed cost function. If the pitch value of one of the phones in a diphone candidate is between certain limits (T1 and T2) then the contribution to the cost from the pitch anchor cost function is zero. If the pitch is outside these limits, the contribution is non-zero.

To specify precisely what value a feature should be, requires a significant amount of linguistic insight. Such linguistic insight is hard to come by. Instead, it is useful to incorporate the lack of precision in our linguistic knowledge in the process of unit selection. Also, since additive cost functions are used, (i.e., the contributions from each feature are all added up to get the final cost) it can happen that one possible combination of units will have almost zero contributions from all its features except one, on which the mismatch is very big; whereas another combination will have very small contributions from every feature. It may be preferable to choose this second combination—i.e., to ensure that very big mismatches weigh more than lots of small mismatches.

In the waveform selector 131, the cost functions used for numerical features may include an outer threshold that is defined per cost function. For example, steep-sided cost functions may be used to push outliers further out. Outside the flatbottomed region, the cost may rise linearly up to this second threshold, where the cost is 'stepped' to a much higher level. (Of course, in other embodiments, a nonlinear cost function rise may be advantageous.) This steep-siding threshold ensures that if there is a pair of features with a very big mismatch (i.e., beyond the threshold) then the cost contribution is made very big. For example, if the pitch mismatch between two speech units is very large, the cost becomes very big which means it is very unlikely that this combination will be chosen on the best path.

Tables 6 and 7 in the Tables Appendix illustrate some examples of cost functions used in the preferred embodiment. For each feature, there is a cost function shape. Some features use the same cost function shapes as other features, whereas other features have specific cost functions designed only for that feature.

Feature 1 in Tables 6 and 7 used in some embodiments of the waveform selector 131 uses the concept of 'pitch anchors' (two per diphone—one for the left phone, one for the right phone) which employ symmetric, flat-bottomed, steepsided cost functions to specify wide pitch ranges per syllable. Pitch anchors are an example of how rather imprecise linguistic knowledge can be included in the operation of the system. Pitch anchors affect the intonation (i.e., the pitch) of the output utterance, but do so without having to specify an exact intonation contour. These pitch anchors can be determined from statistical analysis of the speech unit database. The range for a particular syllable is chosen from a lookup table depending on features such as sentence type (e.g. statement, question), whether the syllable is sentence-final or not, if the syllable is stressed or not, etc. For example, pitch anchors may be specified as follows:

| ID | min | 30% -> | <- 70% | max |
|---|---|---|---|---|
| DEFAULT_ACC | 18.00 | 21.36 | 24.34 | 27.00 |
| DEFAULT UN_ACC | 18.00 | 21.05 | 24.00 | 26.50 |
| EXTERN_FIRST | 21.00 | 24.70 | 26.51 | 30.00 |
| EXTERN_LAST | 14.00 | 16.83 | 18.37 | 24.03 |
| EXTERN_PENULT | 10.00 | 10.00 | 100.0 | 100.0 |
| INTERN_FIRST | 18.00 | 20.72 | 22.38 | 25.00 |
| INTERN_LAST | 17.00 | 19.78 | 22.13 | 24.00 |

For the purpose of applying these pitch constraints, a sentence is viewed as being composed of syllables. Important syllables are the very first in the sentence (EXTERN_FIRST) and the last two in the sentence (EXTERN_PENULT and EXTERN_LAST). Since phrase boundaries inside the sentence are usually associated with a declination offset, the syllable just before such an 'internal' phrase boundary (INTERN_LAST) and just after it (INTERN_FIRST) are also viewed as important. Everything else has a pitch anchor based on its accentuation (DEFAULT_UNACC and DEFAULT_ACC). The four numbers alongside each anchor parameterize the probability density function of the pitch range.

The limits used in this example were 30% and 70%. Thus, for the example of sentence-initial sonorant syllables in the statement database (EXTERN_FIRST), the minimum pitch encountered is 21.0, the maximum is 30.0. The 30% and 70% cut off points are 24.70 and 26.51 respectively. If a candidate has a pitch within the 30% and 70% points, the cost for this feature will be zero (cost function is flat-bottomed). The costs rises linearly as the candidate pitch-pitch anchor mismatch increases beyond these cut off points. Beyond the min and max values, the cost rises sharply (cost function is steep-sided).

Feature 2 in Tables 6 and 7 represents pitch difference. For this cost function, x1 and x2 are interval (the pitch values in semitones—Note: the pitch values could be in semitones, Hz, quarter semitones etc). This cost function uses the pitch difference z=x1−x2, where x1 is the pitch at the right edge of the left speech unit, and x2 is the pitch at the left edge of the right speech unit. In other words, z is the difference in pitch between the two speech units at the place at which they would be joined, if selected. Table 7 shows the shapes of the pitch difference cost function y=f(z) from Table 6 such that:

If x1=x2 (->z=0), the cost is 0.

If z>0, the cost rises linearly until z=R (R=a range value set by the user), i.e., y=Az (A=constant)

If z<0, the cost rises linearly until z=−R (R=a range value set by the user). i.e., y=Az.

If z>R or z<−R, y=B (B=a constant, currently set to B=2R).

Feature 3 in Tables 6 and 7 represents the spectral distance. Spectral distance is an interval feature in which x1 and x2 are vectors that describe the spectrum at the potential joining point. The variable z maybe, for example, the RMS (rootmean-square) distance between the two vectors. Thus if two vectors are dissimilar, they will have a large z, and if they are identical they will have z=0.

z is non-negative.

If x1=x2 (->z=0), the cost is 0.

If z>0, the cost rises linearly until z=R (R=a range value set by the user), i.e., y=Az (A=constant).

If z>R, y=B (B=a constant, currently set to B=2R).

Duration scoring is similar in operation to the pitch anchoring described above. A linguistically-motivated classification of phones can be made, and this can be used with a statistical analysis of the speech unit database, to make a table of duration cost function parameters for certain phones, or phone classes, in various accentuation and/or sentence position environments.

Feature 4 in Tables 6 and 7 represents a duration cost function. This is an interval feature in which x1 is the duration of the right demiphone (=half phone) that comes from the left speech unit, and x2 is the duration of the left demiphone that comes from the right speech unit. So if the speech unit #a is being joined to the speech unit ab, x1 is the duration of 'a' in #a, and x2 is the duration of 'a' in ab. z is then z=x1+x 2. The shape of the cost function is flat bottomed, steep-sided. The lower and upper limit values shown in Table 7 are determined by a lookup operation based on the description of the target phoneme. So there will one lower and upper limit for 'a' in sentence final position with stress, and another for 'a' in sentence non-final position without stress.

z=x1+x2 is non-negative call the lower limits L_outer and L_inner, and the upper limits U_inner and U_outer L_outer<L_inner<U_inner<U_outer If z>L_inner and z<U_inner, y=0.0

If z>=U_inner and z<U_outer, y rises linearly y=A(z−U_inner)

If z<=L_inner and z>L_outer, y rises linearly y=−A(z−L_inner)

If z<=L_outer, y=B (constant)

If z>=U_outer, y=B (constant)

Table 8 in the Tables Appendix shows a part of the duration pdf table for English. A linguistically based classification resulted in the classes #$?DFLNPRSV being defined. Some of these are single-phoneme classes (e.g., #, $ and ?) while others represent groupings of phonemes with similar duration properties (F=fricatives, V=vowels, L=liquids). The accentuation and phrase finality of the phonemes is also accounted for. For example, for accented fricatives in non-phrase final position (F Y N in Table 9), the cut off points in the pdf are 56.2 and 122.9 ms. If the target phoneme is a fricative of this type (F Y N) then the candidate demiphone combination will get a cost of 0 if its duration (the sum of the durations of the left and right demiphones) is near the center of the region between these limits. If the duration is outside the specified limits, the cost is large.

As well as continuity between speech units, a more prosodically-motivated coarse pitch continuity may also be used as a cost function (Features 5 and 6 in Tables 6 and 7). One of these ensures continuity from accented syllable to accented syllable, the other enforces a rise from unaccented syllable to accented syllable. At phrase boundaries, memory of the pitch of previous syllables is cleared to encourage the pitch resets witnessed in real speech. These features can be used to ensure that the pitch of successive accented syllables in a phrase drifts downwards in an effect widely known as declination.

Feature 5 in Tables 6 and 7 represents vowel pitch continuity (acc-acc unacc-unacc). This cost function is only evaluated when all the following conditions are met:

the left demiphone of the right speech unit is unvoiced, the right demiphone of the right speech unit is voiced, and the left demiphone of the left speech unit has the same stress as the right demiphone of the right speech unit, and it is voiced, OR there is a left demiphone somewhere earlier in the same phrase as the right speech unit, which has the same stress as the right demiphone of the right speech unit, and is also voiced.

If these conditions are met, x1 is the pitch of the previous left voiced same-stressed demiphone (from the left speech unit, or earlier, x2 is the pitch of the right demiphone of the right speech unit, and z=|x1−x2|.

If z<R1 (R1 set by user), then y=0.

If z>=R1 and z<R2, y=Az (i.e., cost rises linearly, A=constant).

If z>R2, y=B (B=constant).

This function prevents sudden pitch changes between accented syllables (and sudden pitch changes between unaccented syllables) in a phrase.

Feature 6 in Tables 6 and 7 represents vowel pitch continuity (unacc-acc). This feature is very similar to Feature 5, except that:

It compares the pitch of an accented phone with that of an unaccented phone. (i.e., it is only used when the right demiphone of the right speech unit is stressed).

It has an asymmetric cost function: x2 is the pitch of the previous left voiced unstressed demiphone (from the left speech unit, or earlier). x1 is the pitch of the right demiphone of the right speech unit. $z=x1-x2$.

If $z<R1$ (R1 set by user), then $y=0$

If $z>=R1$ and $z<R2$, $y=Az$ (i.e., cost rises linearly, A=constant)

If $z>R2$, $y=B$ (B=constant)

Significantly, if $z<0$, $y=B$ (i.e., if pitch tries to go DOWN, cost is immediately high).

This function encourages accented syllables to have higher pitch values than the previous unaccented syllables in a phrase. There is an opposite of this function which encourages the pitch to go DOWN between accented and unaccented syllables.

Context Dependent Cost Functions

The input specification is used to symbolically choose the best combination of speech units from the database which match the input specification. However, using fixed cost functions for symbolic features, to decide which speech units are best, ignores well-known linguistic phenomena such as the fact that some symbolic features are more important in certain contexts than others.

For example, it is well-known that in some languages phonemes at the end of an utterance, i.e, the last syllable, tend to be longer than those elsewhere in an utterance. Therefore, when the dynamic programming algorithm searches for candidate speech units to synthesize the last syllable of an utterance, the candidate speech units should also be from utterance-final syllables, and so it is desirable that in utterance-final position, more importance is placed on the feature of "syllable position". These sort of phenomena vary from language to language, and therefore it is useful to have a way of introducing context-dependent speech unit selection in a rule-based framework, so that the rules can be specified by linguistic experts rather than having to manipulate the actual parameters of the waveform selector 131 cost functions directly. Thus the weights specified for the cost functions may also be manipulated according to a number of rules related to features, e.g. phoneme identities. Additionally, the cost functions themselves may also be manipulated according to rules related to features, e.g. phoneme identities. If the conditions in the rule are met, then several possible actions can occur, such as (1) For symbolic or numeric features, the weight associated with the feature may be changed—increased if the feature is more important in this context, decreased if the feature is less important. For example, because 'r' often colors vowels before and after it, an expert rule fires when an 'r' in vowel-context is encountered which increases the importance that the candidate items match the target specification for phonetic context.

(2) For symbolic features, the fuzzy table which a feature normally uses may be changed to a different one.

(3) For numeric features, the shape of the cost functions can be changed.

Some examples are shown in Table 5 in the Tables Appendix, in which * is used to denote 'any phone', and [ ] is used to surround the current focus diphone. Thus r[at]# denotes a diphone 'at' in context r_#.

Speedup Techniques

Various methods may also be used by the waveform selector 131 to speed up the unit selection process. For example, a stop early cost calculation technique is used in the calculation of the transition cost making use of the fact that the transition cost is calculated so that the best predecessor to each candidate can be found. This has no impact on the qualitative aspect of unit selection, but results in fewer calculations, thereby speeding up the unit selection algorithm in the waveform selector 131.

To illustrate with an example, consider a current candidate A, with 3 possible predecessors B1, B2 and B3. First calculate the cost of joining B1 to A. B1 is for now the lowest cost candidate. Next, rather than computing the complete cost B2 to A and comparing it to B1 to A, start calculating the contributions of each feature for joining B2 to A. Start with the feature with the highest weight, and after a feature's contribution has been calculated, check whether the accumulated cost is bigger than the cost B1 to A. If it's already bigger than the cost B1 A, stop the calculation and go on to B3. By stopping every cost calculation as soon as the accumulated cost is bigger than the one on the lowest path, fewer cost calculations are required.

Another speed up technique uses concepts of pruning, well-known in the art. Although there are large numbers of many speech units, they don't all match the target specification very well; thus, an efficient pruning system is implemented:

(1) The user specifies a maximum length N for each candidate list, (2) As new candidates are retrieved, the system does the following:

If the list length is<N, put the new candidate in the list using a bubble sort so the best candidate is at the top;

If the list length is=N, compare the new candidate to the last one in the list;

If the new candidate has a higher cost than the last one, discard it;

If the new candidate has a lower cost than the last one, use a bubble sort to place the new candidate in the list at the appropriate place.

The stop-early mechanism can also be used for node cost calculation with pruning once N candidates have been evaluated, then the cost of the Nth item (the worst candidate) can be used as the threshold for stopping node cost calculation early.

Scalability

System scalability is also a significant concern in implementing representative embodiments. The speech unit selection strategy offers several scaling possibilities. The waveform selector 131 retrieves speech unit candidates from the speech unit database 141 by means of lookup tables that speed up, data retrieval. The input key used to access the lookup tables represents one scalability factor. This input key to the lookup table can vary from minimal—e.g., a pair of phonemes describing the speech unit core-to more complex—e.g., a pair of phonemes+speech unit features (accentuation, context, . . . ). A more complex input key results in fewer candidate speech units being found through the lookup table. Thus, smaller (although not necessarily better) candidate lists are produced at the cost of more complex lookup tables.

The size of the speech unit database 141 is also a significant scaling factor, affecting both required memory and processing speed. The more data that is available, the longer it will take to find an optimal speech unit. The minimal database needed consists of isolated speech units that cover the phonetics of the input (comparable to the speech data bases that are used in linear predictive coding based phonetics-to-speech systems). Adding well chosen speech signals to the database, improves the quality of the output speech at the cost of increasing system requirements.

The pruning techniques described above also represents a scalability factor which can speed up unit selection. A further scalability factor relates to the use of a speech coding and/or speech compression techniques to reduce the size of the speech database.

One of the features used in the transition cost is the spectral mismatch between consecutive segments. The calculation of this spectral mismatch is based on a distance calculation between spectral vectors. This might be a heavy task as there can be many segment combinations possible. In order to reduce the computational complexity a combination matrix—containing the spectral distances—could be calculated in advance for all possible spectral vectors occurring at diphone boundaries. As the speech segment database grows this approach would require ever increasing memory. An efficient solution is to vector quantize (VQ) the set of possible spectral vectors occurring at diphone boundaries. Based on the results of this VQ, a distance lookup table can be constructed, whose size can be kept constant independent of the database size. Because the phoneme distribution is far from uniform it is appropriate to vector quantize on a phoneme-by-phoneme basis instead of performing a uniform VQ over the whole database. This process results in a set of phoneme-dependent VQ distance tables.

Signal Processing/Concatenation

The speech waveform concatenator 151 performs concatenation-related signal processing. The synthesizer generates speech signals by joining high-quality speech segments together. Concatenating unmodified PCM speech waveforms in the time domain has the advantage that the intrinsic segmental information is preserved. This implies also that the natural prosodic information, including the micro-prosody, one of the key factors for highly natural sounding speech, is transferred to the synthesized speech. Although the intra-segmental acoustic quality is optimal, attention should be paid to the waveform joining process that may cause inter-segmental distortions. The major concern of waveform concatenation is in avoiding waveform irregularities such as discontinuities and fast transients that may occur in the neighborhood of the join. These waveform irregularities are generally referred to as concatenation artifacts. It is thus important to minimize signal discontinuities at each junction.

The concatenation of the two segments can be readily expressed in the wellknown weighted overlap-and-add (OLA) representation. The overlap and-add procedure for segment concatenation is in fact nothing else than a (non-linear) short time fade-in/fade-out of speech segments. To get high-quality concatenation, we locate a region in the trailing part of the first segment and we locate a region in the leading part of the second segment, such that a phase mismatch measure between the two regions is minimized.

This process is performed as follows:

We search for the maximum normalized cross-correlation between two sliding windows, one in the trailing part of the first speech segment and one in the leading part of the second speech segment.

The trailing part of the first speech segment and the leading part of the second speech segment are centered around the diphone boundaries as stored in the lookup tables of the database.

In the preferred embodiment the length of the trailing and leading regions are of the order of one to two pitch periods and the sliding window is bell-shaped.

In order to reduce the computational load of the exhaustive search, the search can be performed in multiple stages. The first stage performs a global search as described in the procedure above on a lower time resolution. The lower time resolution is based on cascaded downsampling of the speech segments. Successive stages perform local searches at successively higher time resolutions around the optimal region determined in the previous stage. The cascaded downsampling is based on downsampling by a factor that is a power of two.

Conclusion

Representative embodiments can be implemented as a computer program product for use with a computer system. Such implementation may include a series of computer instructions fixed either on a tangible medium, such as a computer readable medium (e.g., a diskette, CD-ROM, ROM, or fixed disk) or transmittable to a computer system, via a modem or other interface device, such as a communications adapter connected to a network over a medium. The medium may be either a tangible medium (e.g., optical or analog communications lines) or a medium implemented with wireless techniques (e.g., microwave, infrared or other transmission techniques). The series of computer instructions embodies all or part of the functionality previously described herein with respect to the system. Those skilled in the art should appreciate that such computer instructions can be written in a number of programming languages for use with many computer architectures or operating systems. Furthermore, such instructions may be stored in any memory device, such as semiconductor, magnetic, optical or other memory devices, and may be transmitted using any communications technology, such as optical, infrared, microwave, or other transmission technologies. It is expected that such a computer program product may be distributed as a removable medium with accompanying printed or electronic documentation (e.g., shrink wrapped software), preloaded with a computer system (e.g., on system ROM or fixed disk), or distributed from a server or electronic bulletin board over the network (e.g., the Internet or World Wide Web). Of course, some embodiments of the invention may be implemented as a combination of both software (e.g., a computer program product) and hardware. Still other embodiments of the invention are implemented as entirely hardware, or entirely software (e.g., a computer program product).

Although various exemplary embodiments of the invention have been disclosed, it should be apparent to those skilled in the art that various changes and modifications can be made that will achieve some of the advantages of the invention without departing from the true scope of the invention. These and other obvious modifications are intended to be covered by the appended claims.

Glossary

The definitions below are pertinent to both the present description and the claims following this description.

"Coarse pitch continuity" refers to the features in items 5 and 6 of Tables 6 and 7.

"Diphone" is a fundamental speech unit composed of two adjacent half-phones. Thus the left and right boundaries of a diphone are in-between phone boundaries. The center of the diphone contains the phone-transition region. The motivation for using diphones rather than phones is that the edges of diphones are relatively steady-state, and so it is easier to join two diphones together with no audible degradation, than it is to join two phones together.

"Flat bottom" cost functions are shown in Tables 6 and 7, including duration PDF, vowel pitch continuity (I) and vowel pitch continuity (II). As disclosed in the text accompanying this table, the approximately flat bottom has the effect of favoring approximately equally all waveform candidates having a feature value lying within an designated range.

"High level" linguistic features of a polyphone or other phonetic unit include, with respect to such unit, accentuation, phonetic context, and position in the applicable sentence, phrase, word, and syllable.

"Large speech database" refers to a speech database that references speech waveforms. The database may directly contain digitally sampled waveforms, or it may include pointers to such waveforms, or it may include pointers to parameter sets that govern the actions of a waveform synthesizer. The database is considered "large" when, in the course of waveform reference for the purpose of speech synthesis, the database commonly references many waveform candidates, occurring under varying linguistic conditions. In this manner, most of the time in speech synthesis, the database will likely offer many waveform candidates from which to select. The availability of many such waveform candidates can permit prosodic and other linguistic variation in the speech output, as described throughout herein, and particularly in the Overview.

"Low level" linguistic features of a polyphone or other phonetic unit includes, with respect to such unit, pitch contour and duration.

"Non binary numeric" function assumes any of at least three values, depending upon arguments of the function.

"Optimized windowing of adjacent waveforms" refers to techniques, operative on first and second adjacent waveforms in a sequence of waveforms to be concatenated, in which there is applied a first time-varying window in the neighborhood of the edge of the first waveform and a second time-varying window in the neighborhood of an adjacent edge of the second waveform, and then there is determined an optimal location for concatenation of the first and second waveforms by maximizing a similarity measure between the windowed waveforms in a region near their adjacent edges.

"Polyphone" is more than one diphone joined together. A triphone is a polyphone made of 2 diphones.

"SPT (simple phonetic transcription)" describes the phonemes. This transcription is optionally annotated with symbols for lexical stress, sentence accent, etc. . . . Example (for the word 'worthwhile'): #'werT-'wYl#.

"Steep sides" in cost functions are shown in the cost functions of Tables 6 and 7, including pitch difference, spectral distance, duration PDF, vowel pitch continuity (I) and vowel pitch continuity (II). As disclosed in the text accompanying this table, the steep sides have the effect of strongly disfavoring any waveform candidate having an undesired feature value.

"Triphone" has two diphones joined together. It thus contains three components—a half phone at its left border, a complete phone, and a half phone at its right border.

"Weighted overlap and addition of first and second adjacent waveforms" refers to techniques in which adjacent edges of the waveforms are subjected to fade-in and fade-out.

TABLES APPENDIX

XPT: 26 phonemes - 2029.400024 ms - CLASS: S

| PHONEME | # | Y | k | U | d | n | b | i | S | U |
|---|---|---|---|---|---|---|---|---|---|---|
| DIFF | 0 | 0 | 0 | 0 | 0 | 0 | 0 | 0 | 0 | 0 |
| SYLL_BND | S | S | A | B | A | B | A | B | A | N |
| BND_TYPE-> | N | W | N | S | N | W | N | W | N | N |
| sent_acc | U | U | S | S | U | U | U | U | S | S |
| PROMINENCE | 0 | 0 | 3 | 3 | 0 | 0 | 0 | 0 | 3 | 3 |
| TONE | X | X | X | X | X | X | X | X | X | X |
| SYLL_IN_WRD | F | F | I | I | F | F | F | F | F | F |
| SYLL_IN_PHRS | L | 1 | 2 | 2 | M | M | P | P | L | L |
| syll_count-> | 0 | 0 | 1 | 1 | 2 | 2 | 3 | 3 | 4 | 4 |
| syll_count<- | 0 | 4 | 3 | 3 | 2 | 2 | 1 | 1 | 0 | 0 |
| SYLL_IN_SENT | I | I | M | M | M | M | M | M | M | M |
| NR_SYLL_PHRS | 1 | 5 | 5 | 5 | 5 | 5 | 5 | 5 | 5 | 5 |
| WRD_IN_SENT | I | I | M | M | M | M | M | M | f | f |
| PHRS_IN_SENT | n | n | n | n | n | n | n | n | n | n |
| Phon_Start | 0.0 | 50.0 | 120.7 | 250.7 | 302.5 | 325.6 | 433.1 | 500.7 | 582.7 | 734.7 |
| Mid_F0 | −48.0 | 23.7 | −48.0 | 27.4 | 27.0 | 25.8 | 24.0 | 22.7 | −48.0 | 23.3 |
| Avg_F0 | −48.0 | 23.2 | −48.0 | 27.4 | 26.3 | 25.7 | 23.8 | 22.4 | −48.0 | 23.2 |
| Slope_F0 | 0.0 | −28.6 | 0.0 | 0.0 | −165.8 | −2.2 | 84.2 | −34.6 | 0.0 | −29.1 |
| CepVecInd | 37 | 0 | 2 | 1 | 16 | 21 | 8 | 20 | 1 | 0 |

| r | h | i | w | $ | z | s | t | I | 1 | $ | s |
|---|---|---|---|---|---|---|---|---|---|---|---|
| 0 | 0 | 0 | 0 | 0 | 0 | 0 | 0 | 0 | 0 | 0 | 0 |
| B | A | B | A | N | B | A | N | N | B | S | A |
| P | N | W | N | N | W | N | N | N | W | S | N |
| X | X | X | X | X | X | X | X | X | X | X | X |
| S | U | U | U | U | U | S | S | S | S | U | S |
| 3 | 0 | 0 | 0 | 0 | 0 | 3 | 3 | 3 | 3 | 0 | 3 |

TABLES APPENDIX-continued

XPT: 26 phonemes - 2029.400024 ms - CLASS: S

| | | | | | | | | | | | |
|---|---|---|---|---|---|---|---|---|---|---|---|
| F | F | F | F | F | F | F | F | F | F | I | F |
| L | 1 | 1 | 2 | 2 | 2 | M | M | M | M | P | L |
| 4 | 0 | 0 | 1 | 1 | 1 | 2 | 2 | 2 | 2 | 3 | 4 |
| 0 | 4 | 4 | 3 | 3 | 3 | 2 | 2 | 2 | 2 | 1 | 0 |
| M | M | M | M | M | M | M | M | M | M | M | F |
| 5 | 5 | 5 | 5 | 5 | 5 | 5 | 5 | 5 | 5 | 5 | 5 |
| f | i | i | M | M | M | M | M | M | M | F | F |
| n | f | f | f | f | f | f | f | f | f | f | f |
| 826.6 | 894.7 | 952.7 | 1023.2 | 1053.6 | 1112.7 | 1188.7 | 1216.7 | 1288.7 | 1368.7 | 1429.9 | 1481.8 |
| 22.1 | 20.0 | 21.4 | 18.9 | 20.0 | 19.5 | −48.0 | −48.0 | 21.4 | 20.0 | 19.5 | −48.0 |
| 22.0 | 20.2 | 21.3 | 19.1 | 19.9 | −48.0 | −48.0 | −48.0 | 21.2 | 20.0 | 19.6 | −48.0 |
| −6.9 | 2.2 | −23.1 | −5.9 | 5.5 | 0.0 | 0.0 | 0.0 | −27.0 | 0.0 | −9.2 | 0.0 |
| 21 | 1 | 22 | 2 | 33 | 11 | 38 | 30 | 25 | 28 | 58 | 35 |

| | | | |
|---|---|---|---|
| 1 | i | p | # |
| 0 | 0 | 0 | 0 |
| N | N | B | S |
| N | N | P | N |
| X | X | X | X |
| S | S | S | U |
| 3 | 3 | 3 | 0 |
| F | F | F | F |
| L | L | L | L |
| 4 | 4 | 4 | 0 |
| 0 | 0 | 0 | 0 |
| F | F | F | F |
| 5 | 5 | 5 | 1 |
| F | F | F | F |
| f | f | f | f |
| 1619.0 | 1677.6 | 1840.7 | 1979.4 |
| 20.0 | 17.2 | 13.3 | 9.4 |
| 19.8 | 17.2 | −48.0 | −48.0 |
| −30.8 | −29.8 | 0.0 | 0.0 |
| 21 | 14 | 26 | 1 |

TABLE 1a

XPT Transcription Example
SYMBOLIC FEATURES (XPT)

| name & acronym | applies to | possible values | When? |
|---|---|---|---|
| phonetic differentiator | phoneme | 0 (not annotated) | no annotation symbol present after phoneme |
| DIFF | | 1 (annotated with first symbol) | first annotation symbol present after phoneme |
| | | 2 (annotated with second symbol) etc | second annotation symbol etc |
| phoneme position in syllable | phoneme | A(fter syllable boundary) | phoneme after syllable boundary |
| SYLL_BND | | B(efore syllable boundary) | phoneme before, but not after, syllable boundary |
| | | S(urrounded by syllable boundaries) | phoneme surrounded by syllable boundaries, or phoneme is silence |
| | | N(ot near syllable boundary) | phoneme not before or after syllable boundary |
| type of boundary following phoneme | phoneme | N(o) | no boundary following phoneme |
| BND_TYPE-> | | S(yllable) | Syllable boundary following phoneme |
| | | W(ord) | Word boundary following phoneme |
| | | P(hrase) | Phrase boundary following phoneme |
| lexical stress | syllable | (P)rimary | phoneme in syllable with primary stress |
| lex_str | | (S)econdary | phoneme in syllable with secondary stress |
| | | (U)nstressed | phoneme in syllable without lexical stress, or phoneme is silence |

TABLE 1a-continued

XPT Transcription Example
SYMBOLIC FEATURES (XPT)

| name & acronym | applies to | possible values | When? |
|---|---|---|---|
| sentence accent | syllable | (S)tressed | phoneme in syllable with sentence accent |
| sent_acc | | (U)nstressed | phoneme in syllable without sentence accent, or phoneme is silence |
| prominence | syllable | 0 | lex_str = U and sent_acc = U |
| PROMINENCE | | 1 | lex_str = S and sent_acc = U |
| | | 2 | lex_str = P and sent_acc = U |
| | | 3 | sent_acc = S |
| tone value | syllable (mora) | X (missing value) | phoneme in syllable (mora) without tone marker, or phoneme = #, or optional feature is not supported |
| TONE | | L(ow tone) | phoneme in mora with tone = L |
| | | R(ising tone) | phoneme in mora with tone = R |
| | | H(igh tone) | phoneme in mora with tone = H |
| | | F(alling tone) | phoneme in mora with tone = F |
| syllable position in word | syllable | I(nitial) | phoneme in first syllable of multi-syllabic word |
| SYLL_IN_WRD | | M(edial) | phoneme neither in first nor last syllable of word |
| | | F(inal) | phoneme in last syllable of word (including mono-syllabic words), or phoneme is silence |
| syllable count in phrase (from first) syll_count-> | syllable | 0..N−1 (N= nr syll in phrase) | |
| syllable count in phrase (from last) syll_count<- | syllable | N−1..0 (N= nr syll in phrase) | |
| syllable position in phrase | syllable | 1 (first) | syll_count-> = 0 |
| SYLL_IN_PHRS | | 2 (second) | syll_count-> = 1 |
| | | I (nitial) | syll_count-> < 0.3*N |
| | | M(edial) | all other cases |
| | | F(inal) | syll_count<- < 0.3*N |
| | | P(enultimate) | syll_count<- = N−2 |
| | | L(ast) | syll_count<- = N−1 |
| syllable position in sentence | syllablle | I(nitial) | first syllable in sentence following initial silence, and initial silence |
| SYLL_IN_SENT | | M(edial) | all other cases |
| | | F(inal) | last syllable in sentence preceding final silence, mono-syllable, and final silence |
| number of syllables in phrase NR_SYLL_PHRS | phrase | N (number of syll) | |
| word position in sentence | word | I(nitial) | first word in sentence |
| WRD_IN_SENT | | M(edial) | not first or last word in sentence or phrase |
| | | f(inal in phrase, but sentence medial) | last word in phrase, but not last word in sentence |
| | | i(initial in phrase, but sentence medial) | first word in phrase, but not first word in sentence |
| | | F(inal) | last word in sentence |
| phrase position in sentence | phrase | n(ot final) | not last phrase in sentence |
| PHRS_IN_SENT | | f(inal) | last phrase in sentence |

TABLE 1b

| XPT Descriptors ACOUSTIC FEATURES (XPT) | | |
|---|---|---|
| name & acronym | applies to | possible values |
| start of phoneme in signal Phon_Start | phoneme | 0..length_of_signal |
| pitch at diphone boundary in phoneme Mid_F0 | diphone boundary | expressed in semitones |
| average pitch value within the phoneme Avg_F0 | phoneme | expressed in semitones |
| pitch slope within phoneme Slope_F0 | phoneme | expressed in semitones per second |
| cepstral vector index at diphone boundary in phoneme CepVecInd | diphone boundary | unsigned integer value (usually 0..128) |

TABLE 2

Example of a fuzzy table for prominence matching

| | | Candidate Prominence | | | |
|---|---|---|---|---|---|
| | | 0 | 1 | 2 | 3 |
| Target Prominence | 0 | 0 | 0.1 | 0.5 | 1.0 |
| | 1 | 0.2 | 0 | 0.1 | 0.8 |
| | 2 | 0.8 | 0.3 | 0 | 0.2 |
| | 3 | 1.0 | 1.0 | 0.3 | 0 |

TABLE 3

Example of a fuzzy table for the left context phone

| | | Candidate left context phone | | | | | |
|---|---|---|---|---|---|---|---|
| | | a | e | I | p | . . . | $ |
| Target Left Context Phone | a | 0 | 0.2 | 0.4 | 1.0 | . . . | 0.8 |
| | e | 0.1 | 0 | 0.8 | 1.0 | . . . | 0.8 |
| | i | 0.9 | 0.8 | 0 | 1.0 | . . . | 0.2 |
| | P | 1.0 | 1.0 | 1.0 | 0 | . . . | 1.0 |
| | . . . | . . . | . . . | . . . | . . . | . . . | . . . |
| | $ | 0.2 | 0.8 | 0.8 | 1.0 | . . . | 0 |

TABLE 4

Example of a fuzzy table for prominence matching

| | | Candidate Prominence | | | |
|---|---|---|---|---|---|
| | | 0 | 1 | 2 | 3 |
| Target Prominence | 0 | 0 | 0.1 | 0.5 | 1.0 |
| | 1 | 0.2 | 0 | 0.1 | 0.8 |
| | 2 | 0.8 | 0.3 | 0 | 0.2 |
| | 3 | /1 | 1.0 | 0.3 | 0 |

TABLE 5

Examples of context-dependent weight modifications

| Rule | Action | Justification |
|---|---|---|
| *[r*]* | Make the left context more important | r can be colored by the preceding vowel |
| r[V*]*, V = any vowel | Make the left context more important | The vowel can be colored by the r. |
| *[X]*, X = unvoiced stop | Make the left context more important | If left context is s then X is not aspirated. This encourages exact matching for s[X*]*, but also includes some side effects. |
| *[*V]r | Make the right context more important | Vowel coloring |
| *[X*]* X = non-sonorant | Make syllable position weights and prominence weights zero. | Sonorants are more sensitive to position and prominence than non-sonorants |

TABLE 6

Transition Cost Calculation Features (Features marked * only 'fire' on accented vowels)

| Feature number | Feature | Lowest cost if... | Highest cost if.. | Type of scoring |
|---|---|---|---|---|
| 1 | Adjacent in database (i.e., adjacent in donor recorded item) | The two speech units are in adjacent position in same donor word | They are not adjacent | 0/1 |
| 2 | Pitch difference | There is no pitch difference | There is a big pitch difference | Bigger mismatch = bigger cost (also depends on cost function) |
| 3 | Cepstral distance | There is cepstral continuity | There is no cepstral continuity | Bigger mismatch = bigger cost (also depends on cost function) |

TABLE 6-continued

Transition Cost Calculation Features (Features marked * only 'fire' on accented vowels)

| Feature number | Feature | Lowest cost if... | Highest cost if.. | Type of scoring |
|---|---|---|---|---|
| 4 | Duration pdf | The duration of the phone (the 2 demiphones joined together) is within expected limits for the target phone ID, accent and position | The duration of the phone is outside that expected for the target phone ID, accent and position | Bigger mismatch = bigger cost |
| 5 | Vowel pitch continuity Acc-acc or unacc-unacc (for declination) | Pitch of this accented(unacc) syl is same or slightly lower than the previous accented (unacc) syl in this phrase | Pitch is higher than previous acc (unacc)syl, or pitch is much lower than previous acc (unacc) syl | Flat-bottomed cost function |
| 6 | Vowel pitch continuity Unacc-Acc* (for rising pitch from unacc-acc) | Pitch is same or slightly higher than the previous unaccented syllable in this phrase | Pitch is lower than previous unacc syl, or pitch is much higher than previous acc syl. | Flat bottomed asymmetric cost function. |

TABLE 7

Weight function shapes used in Transistion Cost calculation

| Transition Cost Feature | Shape of cost function |
|---|---|
| 1 Adjacent in database | If items are adjacent cost = 0. Otherwise cost = 1) |
| 2 Pitch Difference | 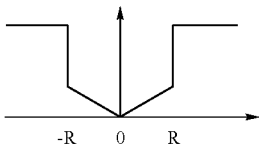  Pitch(right demiphone)-pitch(left demiphone) R = range |
| 3 Cepstral Distance | 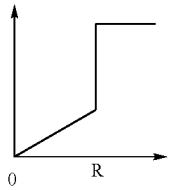  Cepstral distance between left demiphone and right demiphone |
| 4 Duration PDF | 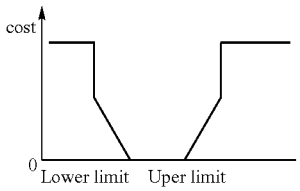  Duration of phone (=dur of left demiphone + dur of right demiphone) |

TABLE 7-continued

Weight function shapes used in Transistion Cost calculation

| Transition Cost Feature | Shape of cost function |
|---|---|
| 5 Vowel pitch continuity (I)* | 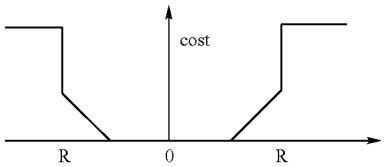  Pitch(now)-pitch(prev syl with same accentuation) |
| 6 Vowel pitch continuity (II)* | 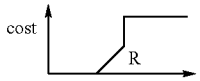  Pitch(now)-pitch(prev unacc syl) |

TABLE 8

Example of a cost function table for categorical variables

| | | x2 | | | |
|---|---|---|---|---|---|
| | | a | e | . . . | z |
| x1 | a | 0.0 | 0.4 | . . . | 0.1 |
| | e | 0.1 | 0.0 | . . . | 0.2 |
| | . . . | . . . | . . . | . . . | . . . |
| | z | 0.9 | 1.0 | . . . | 0 |

TABLE 9

Duration PDF Table

[FEATURES]
CLASS #$?DFLNPRSV
ACCENT YN
PHRASEFINAL YN
[DATA]

| | | | | |
|---|---|---|---|---|
| # | N | N | 48.300000 | 114.800000 |
| # | N | Y | 0.000000 | 1000.000000 |
| # | Y | N | 0.000000 | 1000.000000 |
| # | Y | Y | 0.000000 | 1000.000000 |
| $ | N | N | 35.300000 | 60.700000 |
| $ | N | Y | 56.300000 | 93.900000 |
| $ | Y | N | 0.000000 | 1000.000000 |
| $ | Y | Y | 0.000000 | 1000.000000 |
| ? | N | N | 50.900000 | 84.000000 |
| ? | N | Y | 59.200000 | 89.400000 |
| ? | Y | N | 51.400000 | 83.500000 |
| ? | Y | Y | 51.500000 | 88.400000 |
| D | N | N | 96.400000 | 148.700000 |
| D | N | Y | 154.000000 | 249.500000 |
| D | Y | N | 117.400000 | 174.400000 |
| D | Y | Y | 176.800000 | 275.500000 |
| F | N | N | 39.000000 | 90.100000 |
| F | Y | N | 56.200000 | 122.90000 |

What is claimed is:

1. A system for speech unit selection comprising:

a large speech database referencing speech waveforms and associated symbolic prosodic features, wherein the speech database is accessed by speech waveform designators, at least one designator being associated with a sequence of one or more diphones; and a speech waveform selector, in communication with the speech database, that selects based, at least in part, on the symbolic prosodic features stored the speech database, waveforms referenced by the speech database, using criteria that favor approximately equally all waveform candidates having low level prosody features within a target range determined as a function of high level linguistic features.

2. A system for speech unit selection comprising:

a large speech database referencing speech waveforms;

a speech waveform selector, in communication with the speech database, that selects waveforms referenced by the speech database using criteria that, at least in part, favor (i) waveform candidates based directly on high level prosody features, and (ii) approximately equally all waveform candidates having low level prosody features within a target range determined as a function of high level linguistic features.

3. A system according to claim 1 or 2, wherein the criteria include a first requirement favoring waveform candidates having pitch within a target range determined as a function or high level linguistic features.

4. A system according to claim 1 or 2, wherein the criteria include a second requirement favoring waveform candidates having a duration with in a target range determined as a function of high level linguistic features.

5. A system according to claim 1 or 2, wherein the criteria include a third requirement favoring waveform candidates having coarse pitch continuity within a target range determined as a function of high-level linguistic features.

6. A system according, to claim 1 or 2, wherein the synthesizer operates to select among waveform candidates without recourse to specific target duration values or speech target pitch contour values over time.

* * * * *